US007169205B2

(12) United States Patent
Lonardi et al.

(10) Patent No.: US 7,169,205 B2
(45) Date of Patent: Jan. 30, 2007

(54) METHOD FOR PRODUCING A MELT IRON IN AN ELECTRIC FURNACE

(75) Inventors: Emile Lonardi, Bascharage (LU); Jean-Luc Roth, Thionville (FR); Paul Berg, Eischen (LU); Fred Weisgerber, Oberkorn (LU); Fred Parasch, Dudelange (LU)

(73) Assignee: Paul Wurth S.A., Luxembourg (LU)

( * ) Notice: Subject to any disclaimer, the term of this patent is extended or adjusted under 35 U.S.C. 154(b) by 133 days.

(21) Appl. No.: 10/468,630

(22) PCT Filed: Feb. 20, 2002

(86) PCT No.: PCT/EP02/01749

§ 371 (c)(1),
(2), (4) Date: Aug. 20, 2003

(87) PCT Pub. No.: WO02/068700

PCT Pub. Date: Sep. 6, 2002

(65) Prior Publication Data

US 2004/0060389 A1 Apr. 1, 2004

(30) Foreign Application Priority Data

Feb. 23, 2001 (LU) ..... 90735
Jun. 13, 2001 (LU) ..... 90788

(51) Int. Cl.
*C21B 11/10* (2006.01)

(52) U.S. Cl. ..... 75/10.14

(58) Field of Classification Search ..... 75/10.63, 75/483, 532, 540, 533; 226/160, 177; 423/322
See application file for complete search history.

(56) References Cited

U.S. PATENT DOCUMENTS 3,940,551 A * 2/1976 Ling et al. ..... 75/10.66
4,701,216 A 10/1987 Spenceley et al.
5,611,838 A * 3/1997 Fritz et al. ..... 75/10.38
5,912,916 A * 6/1999 Hendrix ..... 373/94
6,582,492 B1 * 6/2003 Roth et al. ..... 75/483

FOREIGN PATENT DOCUMENTS

WO WO 00/79012 12/2000

* cited by examiner

*Primary Examiner*—Roy King
*Assistant Examiner*—Kathleen McNelis
(74) *Attorney, Agent, or Firm*—McCormick, Paulding & Huber LLP

(57) ABSTRACT

A process for producing liquid smelting iron in an electric arc furnace includes several electrodes, equipped with a hearth, and containing a heel covered with a non-foaming liquid slag. The process further includes the reduction of the metallic fines, in order to form pre-reduced metallic fines containing an excess of free carbon; the hot transfer of the pre-reduced metallic fines within a curtain of inert gas into the heel contained in the electric arc furnace; the agitation of the heel by the injection of gas in such a manner that the formation of crusts is avoided; and the smelting of the pre-reduced metallic fines in the electric arc furnace in order to obtain the liquid smelting iron.

16 Claims, 3 Drawing Sheets

METHOD FOR PRODUCING A MELT IRON IN AN ELECTRIC FURNACE

CROSS-REFERENCE TO RELATED APPLICATIONS

This application is entitled to the benefit of and incorporates by reference in their entireties essential subject matter disclosed in International Application No. PCT/EP02/01749 filed on Feb. 20, 2002, Luxembourg Patent Application No. 90 788 filed on Jun. 13, 2001 and Luxembourg Patent Application No. 90 735 filed on Feb. 23, 2001.

FIELD OF THE INVENTION

The invention concerns a process for the production of liquid smelting iron.

BACKGROUND OF THE INVENTION

Considerable effort has been expended over many years to develop reduction/smelting processes that could replace blast furnaces for the production of liquid smelting iron, especially within the framework of small volume production units, and which avoid the preparation of materials, in other words, using ore fines and coal directly. Processes of this type are interesting since, in principle, installations involving a considerable investment, such as installations for producing coke and installations for ore agglomeration, can be avoided.

Direct reduction processes (without going through a liquid phase) using coal as a reducing agent are the most economical, particularly in countries without natural gas resources. However, a disadvantage of these processes is that they produce a pre-reduced iron ore with a high sulphur content (0.3–0.6% S by weight).

Amongst these processes, those using ore in the form of fine particles (fluid bed or multiple hearth furnace technologies) are especially interesting because they involve the least onerous form of ore. The particles of pre-reduced iron ore, also obtained in the form of fines, may be used without any difficulties in electric furnaces for producing steel, using cold or low temperature (<300° C.) blast injection procedures.

However, the massive use of this type of pre-reduced iron ore particles in steel producing electric furnaces poses two problems: it introduces a lot of sulphur, which is not eliminated in the oxidising metallurgical environment of steel producing electric furnaces, and it reduces the productivity of the electric furnace since their reduction—smelting from cold consumes more energy than that consumed by the principal raw material, scrap iron. This leads to over consumption of energy and, as a consequence, a loss of productivity.

These disadvantages can be avoided by producing smelting iron instead of steel. In fact, by directly introducing the particles of pre-reduced iron ore (the pre-reduced fines) from the reduction furnace, at a temperature of around 1000° C., into an electric furnace producing smelting iron, it is possible to get rid of the sulphur. In fact, feeding particles of pre-reduced iron ore into the furnace at 1000° C. considerably reduces the energy required for smelting. The production of smelting iron requires a reductive medium that makes it possible to reduce the amount of sulphur by nearly 90%. By creating a suitable slag, it is possible to obtain smelting iron with a sulphur content of 0.03–0.06%, which corresponds to a standard grade of smelting iron, which may then be used in all of the traditional uses of smelting iron, and in particular as a source of pure iron in electric furnaces.

All of this is true, particularly for the treatment, by reduction, of waste in the form of fines, which always gives a pre-reduced iron ore with a very high sulphur content. In the following description, "metallic fines" will be understood to mean all types of products containing partially oxidised metallic iron. The metallic fines represent particles of iron ore, all types of particles of waste containing partially oxidised iron and particularly fine particles from filters of blast furnace and electric furnaces, mill scale slivers or particles (iron oxides formed while re-heating or rolling), rolling or machining tailings, etc.

This type of smelting of fine metallic particles for the production of smelting iron is traditionally carried out in a resistance heating slag furnace, incorrectly called a submerged arc furnace (SAF). The fines are generally introduced into this type of electric furnace cold, by means of gravity. However, this type of electric furnace has limited power. In fact, the power density of a submerged arc furnace (SAF), expressed in $MW/m^2$, is less, by a factor of five, than that of a free arc furnace. In order to obtain equivalent production levels, a submerged arc furnace with a diameter more than two times larger than that of an arc furnace has to be used.

In addition, in electric arc furnaces, the smelting of non-injectable finely divided materials leads to the formation of agglomerates, which are commonly called linings or berms, which stick to the walls. This is also the case during the smelting of finely ground scrap, turnings, millings, etc. The over-use of these materials obstructs part of the volume of the vessel, preventing correct introduction of the scrap, and the operator has to regularly carry out cleaning smelts by considerably overheating the furnace, which explains the loss of energy and production. As a consequence, the introduction by gravity of pre-reduced metallic fines into the electric furnace without taking any special precautions will inevitably lead to accretions and the formation of linings.

Under normal conditions of electric arc furnace operation, a foaming slag is used; in traditional smelting of scrap iron, the foaming of the slag is obtained by jointly blast injecting carbon and oxygen in order to form CO gas in the slag. When pre-reduced material rich in carbon (>2% C) is used, this foaming of the slag is spontaneous, since the pre-reduced iron ore provides both oxygen and carbon. Due to its low density and its thermal insulating properties, the foaming slag acts as an obstacle to the dissolution of the pre-reduced fines. The pre-reduced fines falling on the slag rapidly agglomerate and form a solid mass that is difficult to smelt, since it is not very dense, and leads to linings on the walls.

To produce smelting iron, carbon has to be used. Obviously, it is possible to inject carbon separately but the optimal method, in economic terms, consists in manufacturing a pre-reduced iron ore with an excess of carbon. This excess of carbon can be in a low proportion linked to the iron. However, when pre-reduced fines with 5–10% C are produced for manufacturing smelting iron, this carbon corresponds mainly to particles of free carbon. However, it is difficult to introduce this free carbon into the metal unless it is injected into the melt. In fact, the free arc electric furnace (unlike the submerged arc furnace, which in fact functions without an arc, by resistance heating) operates in a mainly oxidising atmosphere, in which the carbon oxidises rapidly. If no special precautions are taken, the input of non-injected carbon will mainly be lost in the gases, and the metal will become impoverished in carbon, and will give therefore a steel.

It would be advantageous to have an optimised process that makes it possible to produce smelting iron directly from particles of pre-reduced metallic fines in an electric arc furnace.

OBJECTS AND SUMMARY OF THE INVENTION.

The purpose of the present invention is to propose an optimised process for producing smelting iron.

According to the present invention, this objective is attained by a process for producing liquid smelting iron in an electric arc furnace comprising several electrodes, equipped with a hearth and containing a heel covered by a liquid non-foaming slag. The process comprises the following stages:

a) reduction of metallic fines in order to form pre-reduced metallic fines containing an excess of free carbon,
b) hot transfer of the pre-reduced metallic fines within a curtain of inert gas into a heel contained in the electric arc furnace,
c) agitation of the heel by the injection of gas in such a way that the formation of crusts is prevented,
d) smelting of the pre-reduced metallic fines in the electric arc furnace in order to obtain the liquid smelting iron.

The proposed process makes use of a free electric arc furnace in a very specific process, which consists in introducing hot pre-reduced metallic fines (preferably directly at the exit of the reduction furnace, in other words, at a temperature greater than 500° C., and, in a particularly preferred embodiment, at a temperature between 800 and 1100° C.), and working on a heel of smelting iron covered by a layer of non-foaming, liquid slag The heel may be agitated by the injection of a neutral gas (nitrogen, argon) through the hearth of the furnace and/or by the injection of gas containing oxygen, via one or several lances. The heel is very vigorously agitated by the injection of gas.

This very energetic agitation makes it possible to homogenise the temperature of the metal+slag melt and to renew the surface of the slag layer so that it remains overheated and fully liquid, and capable of absorbing the pre-reduced metallic fines without these solidifying and forming an impermeable crust.

In the case where the heel is agitated by the injection of a neutral or inert gas through the hearth of the electric arc furnace, the flow rate for the inert gas in the proposed process is preferably between 50 l/min. t (litres per minute per tonne of liquid metal in the melt) and 150 l/min. t. In a particularly preferred embodiment of the invention, the agitation rate is between 80 and 120 l/min. t. These rates have to be adjusted as a function of the height of the heel and the number and the position of the injection points. The high rate of agitation has no relation to the normal practices used in electric arc furnaces. In fact, the agitation rate in conventional processes for producing steel in an electric arc furnace is situated in the range 1 to 10 l/min. t and is only intended to homogenise the melt and even out the metallurgical results and the temperature.

In order to guarantee the optimum efficiency of the agitation, the metallic heel must have a certain minimum height, preferably a height of at least 0.3 m, in order to ensure that the metal melt is vigorously agitated. It is necessary to avoid injecting the agitation gas through the hearth of the furnace simply via a "hole" through the metal melt, without agitating it vigorously. Obviously, this minimum height can vary as a function of the configuration of the electric arc furnace and the positioning of the gas injection devices, which are, preferably, porous bricks or even nozzles.

In a particularly preferred embodiment of the invention, the devices used for injecting the agitation gas are located near to the exterior edge of the hearth of the electric arc furnace, in other words laterally in relation to the bottom of the melt, in such a way that the particles of pre-reduced metallic fines remaining or having a tendency to agglomerate at the edges of the furnace are brought towards the hottest central area, situated between the electrodes.

Alternatively, or in addition to, the agitation of the heel by the injection of inert gas through the hearth of the electric arc furnace, the agitation of the heel is carried out by the injection of gas containing oxygen via one or several injectors. By injecting gas containing oxygen (hereafter called "primary oxygen") into the heel using a penetrating jet, bubbles of gaseous CO are formed by the reaction of C with the smelting iron. This liberation of CO in the liquid metal creates turbulence, which ensures vigorous agitation of the heel and the slag.

In order to protect the pre-reduced metallic fines while they are dropping into the furnace, they are surrounded by a curtain of inert gas, preferably nitrogen or argon. The inert gas curtain, which preferably has an annular shape, makes it possible to minimise the particles being swept laterally by the furnace induction and the re-oxidisation of the pre-reduced metallic fines before they reach the layer of slag and heel respectively. Preferably, a flow of nitrogen of around 50 $Nm^3/h$ to 200 $Nm^3/h$ is used to form the protective curtain and thus to protect the transfer of around 10 to 60 t/h of pre-reduced metallic fines containing around 50% metallised Fe at a level between 60 and 100%. These values depend on numerous factors, such as the geometry of the furnace, the drop height of the fines, and the turbulence within the electric arc furnace, etc., and should, in consequence, be adapted.

Preferably, the transfer of the pre-reduced metallic fines is carried out in the central region of the electric arc furnace, located between the electrodes.

According to a preferred embodiment of the invention, coal with preferably a diameter of between 2 and 20 mm is mixed with the very reduced metallic fines before they are fed into the electric arc furnace. The quantity of coal used depends on the quantity of carbon in the pre-reduced metallic fines. An excess of between 7% and 15%, and preferably around 10%, of carbon is sought. In this way, it is possible to obtain a smelting iron with 3–3.5% C, 0.01–0.05% Si and 0.03–0.06% S, depending on the sulphur content in the coal.

According to another particularly preferred embodiment of the invention, stage a) comprises the following steps:

a 1) the metallic fines are introduced into a multi-hearth furnace comprising several superimposed hearths and they are deposited onto the upper hearth of the multi-hearth furnace,
a 2) the metallic fines are gradually transferred to the lower hearths
a 3) a carbon reducing agent is introduced onto one or several of the lower hearths in sufficient quantity to reduce the metallic fines and ensure that there is an excess of free carbon,
a 4) the multi-hearth furnace is heated and the metallic fines are reduced when they come into contact with the carbon reducing agent and the gases produced by the carbon reducing agent at suitable temperatures, a 5) the excess of gas produced by the carbon reducing agent is burned off within the multi-hearth furnace and the resulting heat is used to dry or preheat the metallic fines. a 1) the metallic fines are introduced into a multi-hearth furnace, comprising several superimposed hearths and they are deposited onto the upper hearth of the multi-hearth furnace.

According to another preferred embodiment of the invention, slag forming agents are added as well during step a) and/or step b). These slag forming agents are preferably selected from a group consisting of lime, flux stone and magnesium oxide, as well as their mixtures.

The excess of carbon at the end of step a) is advantageously between 7% and 15% and preferably around 10%.

The solid carbon reducing agent is selected from coal or liquid or solid petroleum products. The volatile fractions contained in the carbon reducing agent are eliminated when they are in the interior of the multi-hearth furnace, and also, in part, the sulphur.

Part of the excess carbon is consumed during step d).

In addition, the free excess carbon is useful for terminating the reduction reactions and for carburising the smelting iron.

According to another aspect of the present invention, the production of the electric arc furnace may be increased, given that the power of electric arcs is limited by the arc voltage due to the length of the "immersed" arc that can be obtained.

Instead of letting it "burn uselessly" with spontaneous inputs of air into the electric arc furnace and by risking allowing the metallic fines to solidify and form an impenetrable crust, it is advantageous to use the excess of carbon from the pre-reduced metallic fines with a maximum energy efficiency in order to increase the productivity of the electric arc furnace.

Obviously, if one wishes to increase the production capacity of smelting iron per hour in the electric arc furnace, it is necessary to increase the flow rate of metallic fines that are introduced into the electric arc furnace. This increase in the flow rate of metallic fines also increases the risk of forming crusts.

This objective is attained by a process for producing liquid smelting iron in an electric arc furnace described above in which one or several post-combustion lances are fitted—they may be associated with one or several injections of primary oxygen—constituting burners with a power comparable to that of electric arcs. These injectors deliver jets of post-combustion gas, preferably between the electric arcs, and in a particularly preferred embodiment, onto the circle of electrodes ("electrode pitch circle")

It is advantageous to position the post-combustion gas jets in such a way as to push the slag into the central part of the electric arc furnace between the electrodes. This reinforces the agitation of the slag in an appreciable manner and makes it possible to permanently maintain the overheated slag very agitated in the region that receives the metallic fines. The high turbulence in the over-heated slag in this region enables the flow rate of metallic fines to be increased without risking the formation of crusts. In fact, without this injection of post-combustion gas, the turbulence in the slag is instead created indirectly by the agitation of the heel by the injection of neutral gas through the hearth of the electric arc furnace and/or by the injection of primary oxygen into the heel via one or several injectors. The fact that the post-combustion gas is injected directly into the layer of slag enables the movements of the slag in the electric arc furnace to be better controlled and positioned, to accelerate the smelting of the metallic fines and to minimise the risk that the non-melted metallic fines are thus pushed and stuck onto the walls.

One of the advantages of the present process is that the operation of the two reactors is optimised. Actually, the fact that a pre-reduced smelting iron containing an excess of free carbon is produced, increases the reduction rate and increases the level of metallisation.

In order to obtain this excess of free carbon, it is necessary to add a suitable quantity of carbon reducing agent during the reduction stage.

Another advantage of the excess free carbon in the pre-reduced iron ore lies in the fact that in the reduction hearths of the reduction reactor, the temperatures are very high and, as a consequence, the carbon reducing agent, as it happens coal, is de-volatilised and de-suiphured to a large extent. It turns out that, during the smelting stage, the de-volatilised coal is more readily soluble in the iron melt than the non de-volatilised coal. In addition, since the carbon reducing agent is subjected to very high temperatures while it is in the interior of the reduction reactor, the sulphur content drops considerably. The smelting iron obtained in this manner has lower sulphur contents. Obviously, coke could have been used instead of coal during the smelting of the partides of pre-reduced iron ore in order to obtain better solubility of the carbon. However, using coke instead of coal increases the production costs and does not resolve the sulphur problem. In fact, coke does not contain volatile materials: however, it contains approximately the same amount of sulphur as the coal used in its production.

The excess of carbon is burned off in the smelting furnace and thus makes it possible to economise electrical energy during the smelting of the particles.

The fact that the carbon reducing agent is only added to the upper hearths of the multi-hearth furnace makes it possible to use the residual heat in the gases to dry and pre-heat the particles or iron ore and completely burn off the carbon monoxide. A separate post combustion stage is not required. Moreover, the higher temperature of these upper hearths reduces even more the level of sulphur in the free carbon.

The unexpected advantages of the invention, therefore, do not lie in a juxtaposition of two known processes but an interaction between two processes.

BRIEF DESCRIPTION OF THE DRAWINGS

Other specific aspects and characteristics of the invention will become clear from the detailed description of an advantageous embodiment described below, as an example, while referring to the sketch given in the appendix. This shows:

DETAILED DESCRIPTION OF THE INVENTION

Figure 1:
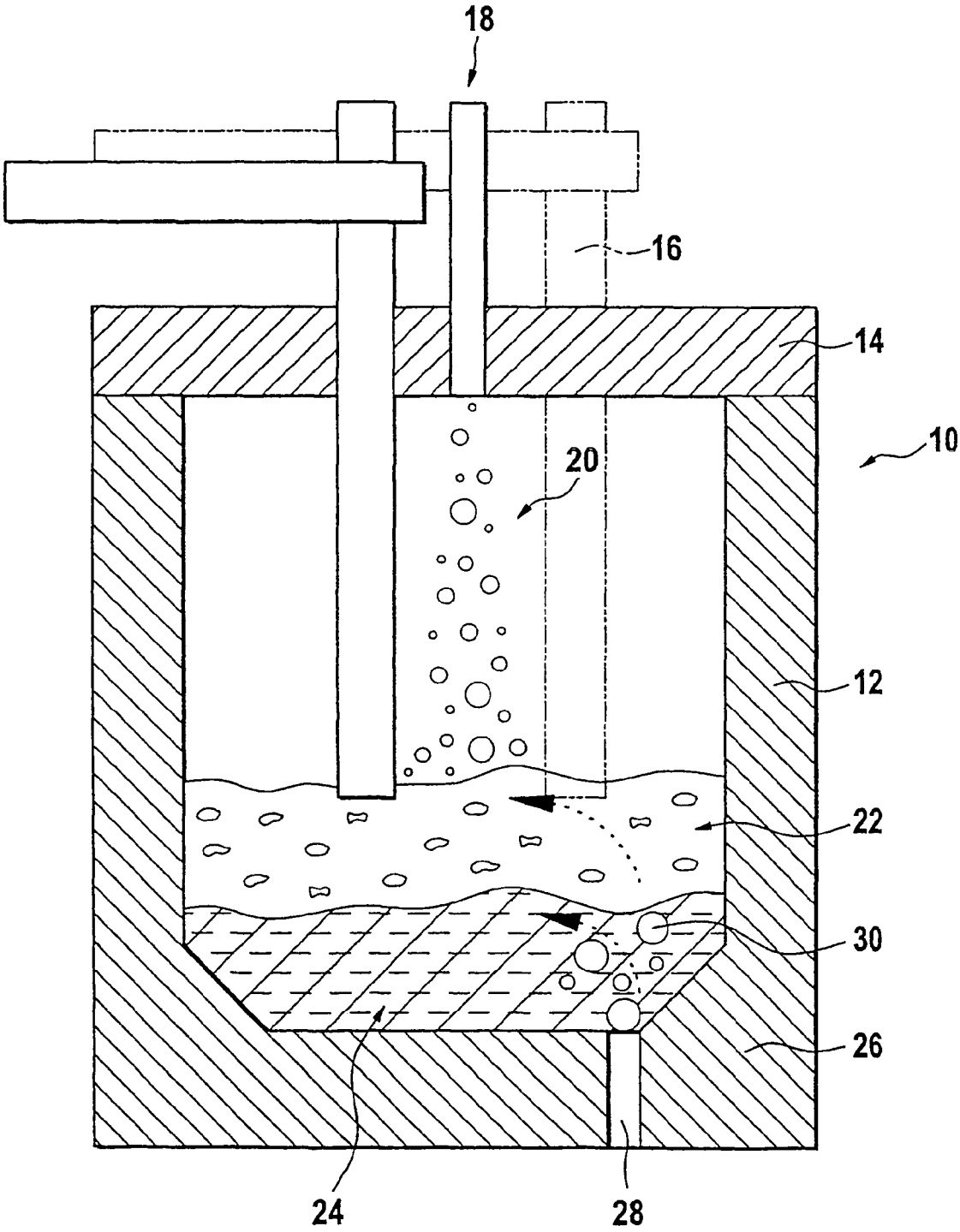

FIG. 1: Section of an electric arc furnace for the production of liquid smelting iron according to a first embodiment of the invention.

Figure 2:
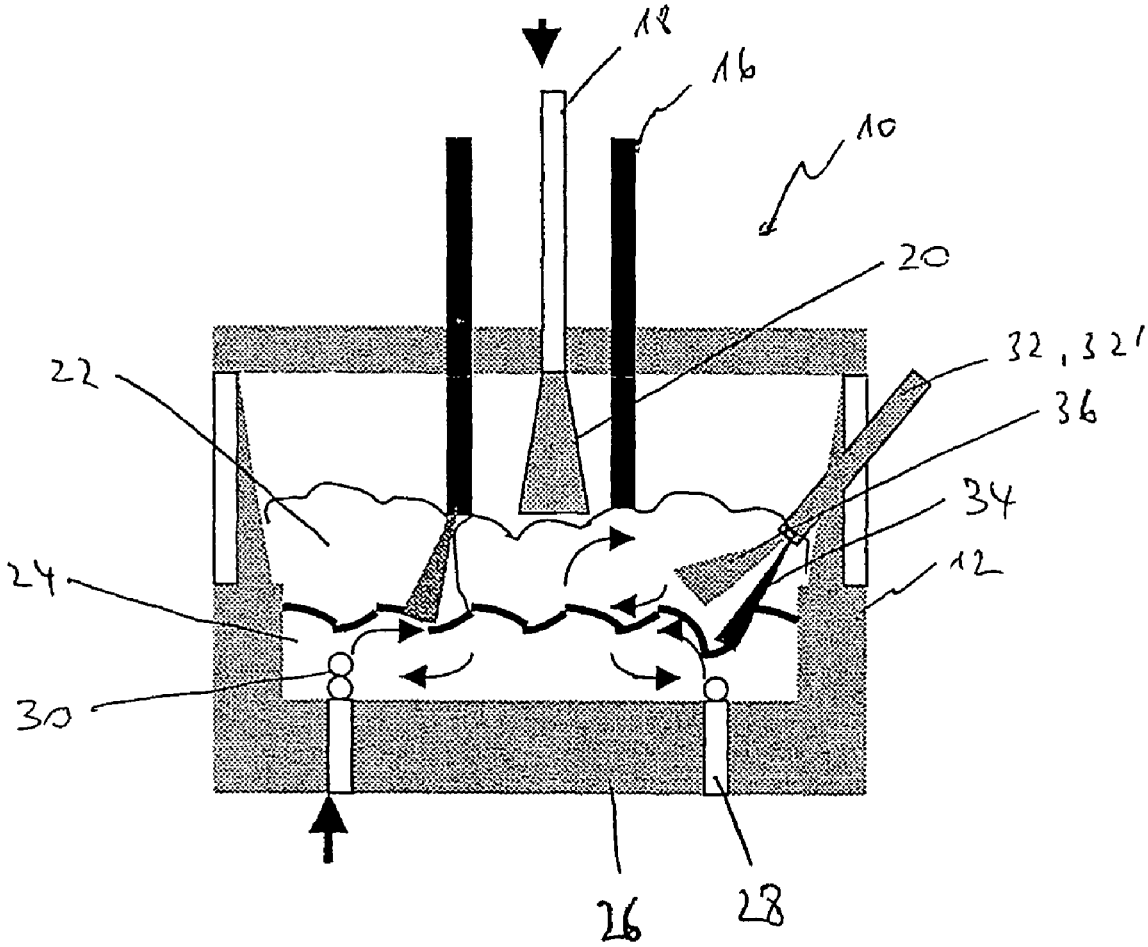

FIG. 2: Section of an electric arc furnace for the production of liquid smelting iron according to a second embodiment of the invention.

Figure 3:
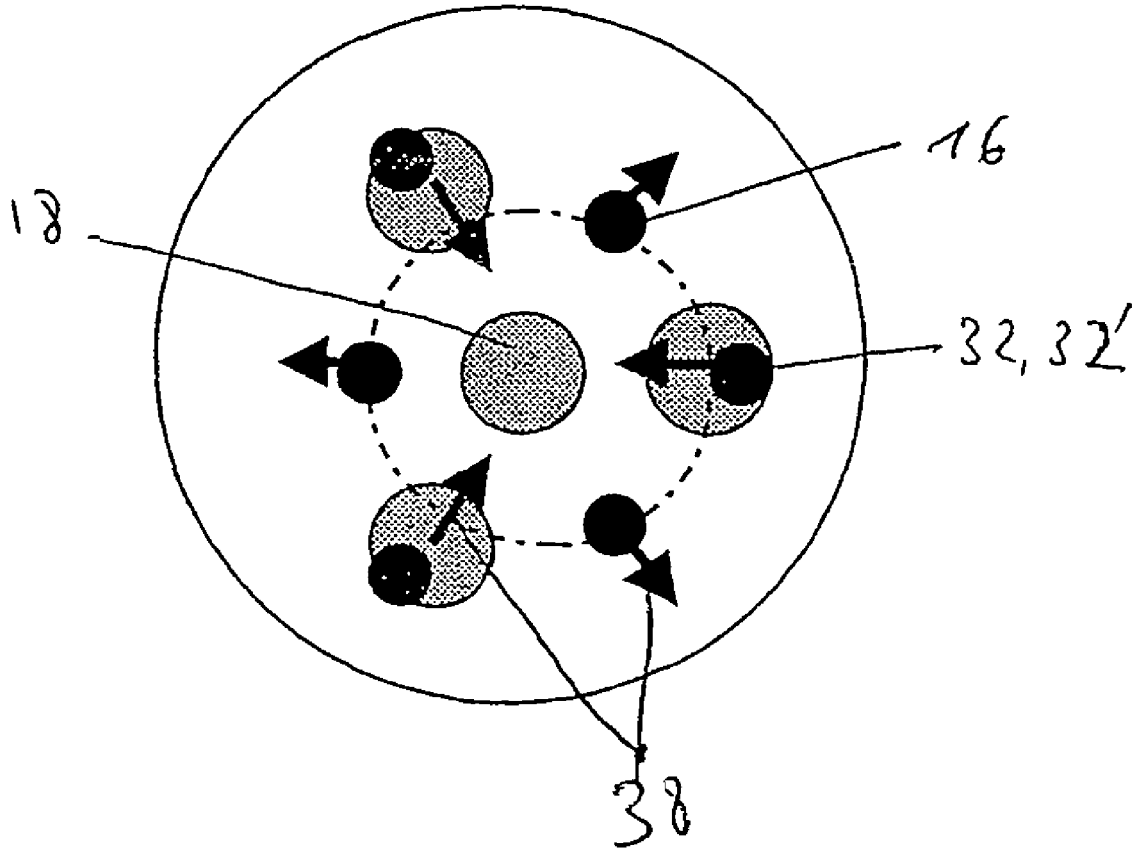

FIG. 3: Plan view of an electric arc furnace according to FIG. 2.

FIG. 1 shows a schematic section of an electric arc furnace for the production of liquid smelting iron according to a first embodiment of the present Invention.

It shows an electric arc furnace, 10, comprising a vessel, 12, covered by a 14, through which three electrodes, 16, penetrate. These electrodes, 16, are capable of producing electric arcs of around twenty centimetres and a power of around 4 MW each. In the middle of these three electrodes, 16, is placed a device, 18, for transferring pre-reduced metallic fines. This device, 18, comprises, on the one hand, a chute for transferring the pre-reduced metallic fines into the furnace, 12, and, on the other hand, an injection nozzle that enables a nitrogen curtain, 20, to be injected, surrounding the pre-reduced metallic fines while they drop into the furnace.

The impact point of the pre-reduced metallic fines is between the three electrodes, 16, in other words, at the hottest spot in the electric arc furnace, 12. At the moment of impact on the layer of non-foaming slag, 22, floating on the liquid melt, 24, the pre-reduced metallic fines are immediately integrated into it and melt rapidly.

The hearth, 26, of the vessel, 12, is equipped with several porous bricks, 28, through which is injected a high flow of agitation gas, 30. The turbulence created by the injection of this gas, 30, through the liquid melt, 24, prevents the pre-reduced metallic fines from agglomerating or forming a crust.

FIG. 2 shows a section of an electric arc furnace for the production of liquid smelting iron according to a second embodiment of the invention. FIG. 3 shows a plan view of this electric arc furnace.

In this electric arc furnace, 10', with central loading by gravity are fitted three post-combustion lances, 32, associated with three primary oxygen injectors, 32', which constitute burners with a power comparable to that of the arcs, between the electric arcs, 33, on the electrode circle ("electrode pitch circle"). The primary oxygen jets, 34, coming from the injectors, 32', are penetrating jets and are positioned in the heel, 24. When the oxygen penetrates into the liquid metal, the oxygen reacts with the carbon contained within the melt and liberates gaseous CO. This liberation of CO creates considerable turbulence within the heel and in the layer of floating slag.

The post-combustion lances, 32, each inject a jet of post-combustion oxygen, 36, or secondary oxygen into the layer of slag, 22. These jets of secondary oxygen, 36, are weaker and less penetrating than the primary oxygen jets, 34, and enable the CO coming from the heel, 24, to be burned following the injection of the primary oxygen. The CO is thus burned within the interior of the layer of the slag, 22. This leads to local overheating of the slag. The jets of post-combustion oxygen, 36, are positioned in such a way so as to impart impulses into the slag that are opposite to those of the arcs, in order to reinforce the agitation of the slag and to push back the slag towards the centre of the electric arc furnace. The movement of the slag caused by the electric arcs, 33, on the one hand and by the post-combustion oxygen jets, 36, on the other hand is represented in FIG. 3 by the arrows, 38. This makes it possible to accelerate the smelting of the pre-reduced metallic fines, and thus to prevent these fines agglomerating and being pushed onto and sticking to the walls of the electric arc furnace.

EXAMPLE 1

For a given electrical power, e.g. limited to 12 MW, the use of additional free carbon and oxygen thus makes it possible to:

- either to melt at least double the flow rate of metallic fines or (DRI)
- or to feed less metallised metallic fines or (DRI) into the furnace, and thus to increase the productivity of the reduction furnace—whatever the technology employed.

In the case of a multiple hearth furnace, the production of 54 or 57 t/h of DRI with a 60% metallisation level could be ensured by a furnace with a capacity of 50% of the capacity that would be necessary to produce 50 t/h of DRI with a 90% metallisation level.

Moreover, the last line of Table 1 shows the possibility of adding additional carbon in the form of free carbon in excess in the DRI.

TABLE 1

Figures for the smelting of DRI fed into the furnace at 1000° C. into smelting iron with 3% C, flowing at 1500° C.:

| DRI Fe level (%) | Amount of metal-lisation (%) | DRI free C (%) | DRI flow rate (t/h) | Smelting iron flow rate (t/h) | Electrical power (MW) | Oxygen flow rate (Nm3/h) | Additional C flow rate (t/h) |
|---|---|---|---|---|---|---|---|
| 80 | 90 | 8 | 50 | 40 | 12 | 0 | 0 |
| 80 | 90 | 8 | 125 | 100 | 12 | 3000 | 2.4 |
| 74 | 60 | 8 | 54 | 40 | 12 | 3600 | 2.6 |
| 71 | 60 | 12 | 57 | 40 | 12 | 3600 | 0 |

LIST OF REFERENCES

10 electric arc furnace
12 vessel
14 vault
16 electrodes
18 transfer device
20 nitrogen curtain
22 slag layer
24 liquid metal melt
26 hearth
28 porous bricks
30 inert gas
32 post-combustion lances
32' primary oxygen injectors
33 electric arcs
34 primary oxygen jets
36 post-combustion oxygen jet
38 slag movement

The invention claimed is:

1. A process for producing liquid smelting iron in an electric arc furnace comprising several electrodes, equipped with a hearth, and containing a heel of smelting iron covered with a non-foaming liquid slag, the process comprising the following steps:

a) reduction of partially oxidized metallic iron containing metallic fines, in order to form pre-reduced metallic fines containing an excess of free carbon, b) hot transfer of the pre-reduced metallic fines within a curtain of inert gas into the heel contained in the electric arc furnace, c) agitation of the heel by injection of gas in such a manner that the formation of crusts is avoided, d) smelting of the pre-reduced metallic fines in the electric arc furnace in order to obtain liquid smelting iron.

2. The process according to claim 1, whereby the transfer of pre-reduced metallic fines is carried out by gravity.

3. The process according to claim 1, whereby the transfer of the pre-reduced metallic fines is carried out egion situated between the electrodes of the electric arc furnace.

4. The process according to claim 1, whereby the agitation of the heel is achieved by the injection of neutral gas through the hearth of the electric arc furnace at a rate between 50 l/min. t and 150 l/min. t.

5. The process according to claim 1, whereby the agitation of the heel is achieved by an injection of gas containing oxygen into the heel via one or several injectors.

6. The process according to claim 1, whereby stage a) comprises the following steps:

a1) the metallic fines are introduced into the multi-hearth furnace with several superimposed hearths and they are deposited onto the upper hearth of the multi-hearth furnace, a2) the metallic fines are gradually transferred to the lower hearths, a3) a carbon reducing agent is added to one or several of the lower hearths in sufficient quantity to reduce the metallic fines and ensure that there is an excess of free carbon, a4) the multi-hearth furnace is heated up and the metallic fines in contact with the carbon reducing agent are reduced and the gases produced by the carbon reducing agent, at suitable temperatures, a5) the, excess of gas produced is burnt off by the carbon reducing agent and the resulting heat is used to dry and pre-heat the metallic fines.

7. The process according to claim 1, whereby during step a) or step b), slag forming agents are added.

8. The process according to claim 7, whereby the slag forming agents are chosen from a group consisting of lime, flux stone and magnesium oxide, as well as their mixtures.

9. The process according to claim 1, whereby the excess of carbon is between 7% and 15%.

10. The process according to claim 1, whereby the carbon reducing agent is coal.

11. The process according to claim 1, whereby the carbon reducing agent is devolatilised during step a).

12. The process according to claim 1, whereby the excess carbon is consumed during step d).

13. The process according to claim 1, whereby the excess carbon is consumed by the injection of a jet of post-combustion gas containing oxygen into the slag via one or several lances.

14. The process according to claim 1, whereby the jet(s) of post-combustion gas is (are) positioned in such as way as to create a movement of the slag towards the electrodes of the electric arc furnace.

15. The process according to claim 1, whereby the agitation of the heel is achieved by the injection of neutral gas through the hearth of the electric arc furnace at a rate between 80 and 120 l/min. t.

16. The process according to claim 1, whereby the excess of carbon is around 10%.

* * * * *

UNITED STATES PATENT AND TRADEMARK OFFICE

CERTIFICATE OF CORRECTION

PATENT NO. : 7,169,205 B2
APPLICATION NO. : 10/468630
DATED : January 30, 2007
INVENTOR(S) : Emile Lonardi et al.

It is certified that error appears in the above-identified patent and that said Letters Patent is hereby corrected as shown below:

Claim 3:
Column 9, line 2, after “out”, please delete “egion” and insert --in a region--.

Signed and Sealed this

Tenth Day of April, 2007

JON W. DUDAS
*Director of the United States Patent and Trademark Office*